US005631036A

United States Patent [19]

Davis

[11] Patent Number: 5,631,036

[45] Date of Patent: May 20, 1997

[54] PEELABLE VACUUM SKIN PACKAGE WITH BARRIER FOAM TRAY

[75] Inventor: Kent A. Davis, Travelers Rest, S.C.

[73] Assignee: W.R. Grace & Co.-Conn., Duncan, S.C.

[21] Appl. No.: 163,970

[22] Filed: Dec. 7, 1993

[51] Int. Cl.[6] ..... B65D 85/00

[52] U.S. Cl. ..... 426/396; 426/106; 426/123; 426/124; 426/129; 426/410; 426/415; 206/484.1; 220/256; 220/257; 220/258

[58] Field of Search ..... 426/87, 106, 123, 426/124, 127, 129, 383, 396, 410, 415; 229/123.25; 206/484.1; 220/256, 257, 258; 53/449, 434

[56] References Cited

U.S. PATENT DOCUMENTS

| | | | |
|---|---|---|---|
| Re. 30,009 | 5/1979 | Perdue et al. | 53/433 |
| 2,925,346 | 2/1960 | Harper et al. | 99/174 |
| 3,360,382 | 12/1967 | Miller | 99/174 |
| 3,491,504 | 1/1970 | Young et al. | 53/22 |
| 3,574,642 | 4/1971 | Weinke | 426/129 X |
| 3,681,092 | 8/1972 | Titchenal et al. | 99/174 |
| 3,713,849 | 1/1973 | Grindrod et al. | 99/174 |
| 3,783,089 | 1/1974 | Hurst et al. | 426/123 X |
| 3,835,618 | 9/1974 | Perdue | 53/112 |
| 3,950,919 | 4/1976 | Perdue | 53/22 |
| 3,966,045 | 6/1976 | Perdue | 206/443 |
| 4,055,672 | 10/1977 | Hirsch et al. | 426/129 X |
| 4,438,850 | 3/1984 | Kahn | 206/634 |
| 4,522,835 | 6/1985 | Woodruff et al. | 426/264 |
| 4,611,456 | 9/1986 | Gillio-Tos et al. | 53/427 |
| 4,833,862 | 5/1989 | Bortolani et al. | 53/427 |
| 4,847,148 | 7/1989 | Schirmer | 428/332 |
| 4,859,514 | 8/1989 | Friedrich et al. | 428/36.6 |
| 4,881,359 | 11/1989 | Schirmer | 53/427 |
| 4,886,690 | 12/1989 | Davis et al. | 428/36.6 |
| 4,889,731 | 12/1989 | Williams, Jr. | 426/129 X |
| 4,890,739 | 1/1990 | Mize, Jr. et al. | 206/459 |
| 4,901,505 | 2/1990 | Williams, Jr. | 426/123 X |
| 4,910,033 | 3/1990 | Bekele et al. | 426/129 |
| 4,935,089 | 6/1990 | Schirmer | 156/272 |
| 4,956,212 | 9/1990 | Bekele | 428/36 |
| 5,024,044 | 6/1991 | Friedrich et al. | 53/433 |
| 5,048,268 | 9/1991 | Brembilla et al. | 53/511 |
| 5,076,436 | 12/1991 | Bortolani et al. | 206/524 |
| 5,087,462 | 2/1992 | Bekele et al. | 426/129 |
| 5,330,777 | 7/1994 | Mize, Jr. et al. | 426/129 X |

FOREIGN PATENT DOCUMENTS

| | | |
|---|---|---|
| 245774 | 2/1963 | Australia . |
| 1258357 | 12/1961 | France . |
| 1286018 | 12/1962 | France . |

*Primary Examiner*—Esther Kepplinger
*Assistant Examiner*—Milton I. Cano
*Attorney, Agent, or Firm*—Rupert B. Hurley, Jr.

[57] ABSTRACT

A package for a product includes a support member having a barrier film disposed thereon and supporting the product; web structure for enclosing the product and the support member, the web structure including a first web and a second web sealed to the first web for enclosing the product wherein the second web includes a non-barrier layer sealed to the first web and a peelable barrier layer; and tab structure for initiating peel of the peelable barrier layer from the non-barrier layer at a location where the non-barrier layer is sealed to the first web whereby peeling of the peelable barrier layer does not cause peeling of the barrier film disposed on the support member.

22 Claims, 2 Drawing Sheets

PEELABLE VACUUM SKIN PACKAGE WITH BARRIER FOAM TRAY

BACKGROUND OF THE INVENTION

The invention relates to a package for fresh red meat products and the like and, particularly, to a vacuum skin package having a peelable barrier layer and a barrier foam tray.

Skin packaging can be classified as a vacuum forming process for thermoformable polymeric films. The product on a supporting member serves as the mold for the thermoformable film which is formed about the product by means of differential air pressure. However, the term "vacuum skin packaging" or VSP as it is referred to hereinafter, refers not only to the fact that the thermoformable film is formed around the product by vacuum or differential air pressure but also to the fact that the product is packaged under vacuum and the space containing the product is evacuated. Thus, there is a need for the film formed around the product and for the support member to be a barrier to oxygen, air, and other gases.

In conventional skin packaging, a backing board which is porous or which is perforated so that a vacuum may be drawn directly through the backing board is employed. In vacuum skin packaging processes generally a vacuum chamber with an open top is used. The product on an impervious backing board is placed on a platform within the vacuum chamber. The top of the chamber is covered by a sheet of film which is clamped tightly against the chamber to form a vacuum tight closure. The chamber is evacuated while the film is heated to its forming and softening temperature. The platform is then raised to drive the product into the softened film and air pressure can be used above the film to force it tightly around the product. A process of this type is disclosed in French Patent No. 1,258,357 which issued to Alain G. Bresson on Mar. 6, 1961.

A variant of the process described in the Bresson patent is disclosed in French Patent No. 1,286,018 which issued on Jan. 22, 1962 to LaRoach Freres Limited. In the LaRoach Freres process, after the chamber has been evacuated and the product driven into the heat softened film, the vacuum is released and ambient air is permitted to enter the chamber so that the thermoplastic film molds more or less onto the product since there is a vacuum on the product side of the film and ambient air pressure on the other side of the film. Australian Patent No. 245,774 which issued to Colbros Proprietary Limited et al on Jul. 16, 1967 discloses a vacuum skin packaging process in which an article to be packaged is inserted within the lower half of a vacuum chamber on a backing board, a thermoplastic film is placed over the open face of the lower half of the chamber, the chamber is closed and both halves are brought to essentially the same state of vacuum, the film is heated and softened, and then atmospheric air is introduced into the upper half of the chamber so that it alone forces the thermoplastic film down around the product and against the backing board.

In another prior art version of vacuum skin packaging, disclosed in U.S. Pat. No. 3,491,504, which issued to W. E. Young et al on Jan. 27, 1970, heat softened film is physically moved down over a stationary product and, in connection with air pressure, the softened thermoplastic film is molded onto the product.

In U.S. Pat. No. RE.30,009, which was reissued on May 29, 1979 to Richard R. Perdue et al, a thermoformable or heat softenable film sheet is drawn by differential air pressure against the concave interior surface of the upper portion of a vacuum chamber, the film is then heated by surface contact, and then, after evacuation of the chamber, air pressure is used to blow the heat softened film down over the product and against the backing board. The resulting package comprises the product positioned on the backing board which is gas impervious and the product is held there by the thermoformable film which has been formed around the product in the exact shape of the product so that it appears to be a "skin." The thermoformable film, as stated previously, is also gas impervious and usually will consist of a number of layers each of which performs a specific function. The product contact and backing member contact layer will be a sealing or heat sealable layer, an interior layer will typically be a barrier layer which comprises a vinylidene chloride copolymer (PVDC) or a hydrolyzed ethylene/vinyl-acetate copolymer (EVOH), and the outer surface layer will be an abuse layer to protect the barrier layer from scratches, pin holes, or from moisture attack.

As set forth above, the mechanics of vacuum skin packaging require an impervious tray or support member. Typical pervious foam trays are coated with an impervious or barrier material for use in VSP.

Also as set forth above, peelable VSP packages are desirable and involve peeling a barrier layer or film or the like from the package to expose a non-barrier layer. The layers to be peeled, however, are sealed to the support member or tray which, it should be recalled, must be a barrier or impervious tray. Because the barrier and non-barrier layers or skins are sealed to the barrier film of the tray, peeling can destroy the packaging by peeling up the barrier film of the tray. This is particularly a problem because the bond between the tray and the barrier film is typically a relatively weak bond. Prior art FIGS. 2 and 3 illustrate the intended operation of such a package (FIG. 2), and the above-described undesirable peeling of the barrier film of the tray which may occur instead (FIG. 3).

It is accordingly a primary object of the invention to provide a package and a method for packaging a product wherein removal of a peelable layer does not damage or destroy the barrier film of a foam barrier tray.

It is another object of the invention to provide such a package having a manual pull tab for initiating peeling of the peelable barrier layer.

Other objects and advantages will appear hereinbelow.

SUMMARY OF THE INVENTION

The foregoing objects and advantages are readily attained by the present invention. According to the invention, products are vacuum skin packaged on a barrier support member or tray with a skin or web having a peelable barrier layer which can be peeled from the package without adversely affecting the barrier film or coating of the tray.

A package in accordance with the invention comprises a support member having a barrier film disposed thereon and supporting the product; means for enclosing the product and the support member, the enclosing means comprising a first web means and a second web means sealed to the first web means for enclosing the product wherein the second web means comprises a non-barrier layer sealed to the first web means and a peelable barrier layer; and means for initiating peel of the peelable barrier layer from the non-barrier layer at a location where the non-barrier layer is sealed to the first web means whereby peeling of the peelable barrier layer does not cause peeling of the barrier film disposed on the support member.

The peel initiating means for initiating the peeling of the barrier layer may be provided at portions of the first and second webs which extend beyond the periphery of the support member. Perforations may also be provided to further facilitate proper peeling.

A package according to the invention may suitably be provided in accordance with the invention by a method including the steps of providing a support member having a barrier film disposed thereon and supporting the product; providing a first and a second web means for enclosing the product wherein the second web means comprises a non-barrier layer and a peelable barrier layer; sealing the non-barrier layer of the second web means to the first web means; and providing means for initiating peel of the peelable barrier layer from the non-barrier layer at a location where the non-barrier layer is sealed to the first web means whereby peeling of the barrier layer does not cause peeling of the barrier film disposed on the support member.

BRIEF DESCRIPTION OF THE DRAWINGS

A detailed description of preferred embodiments of the invention follows, with reference to the attached drawings, wherein.

DETAILED DESCRIPTION

Figure 1:
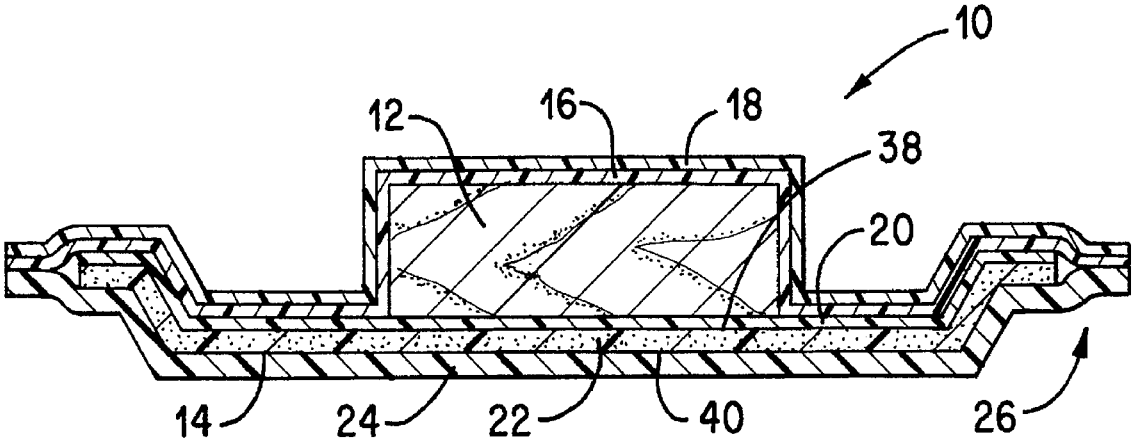
FIG. 1 is a cross-section of a package according to the invention.

FIG. 1 illustrates a package 10 for a fresh red meat product 12, according to the invention. Package 10 includes a support member such as a barrier tray 14 supporting a product 12 thereon. Tray 14 with product 12 thereon is enclosed between a bottom web 24 and a top web which includes a non-barrier layer 16 which is oxygen permeable, and a peelable oxygen barrier layer 18. Barrier tray 14 and barrier layer 18 define an interior space of the package 10 for containing the product in a vacuum packaged state so as to greatly improve the shelf life of product 12. Further, peelable barrier layer 18 can be peeled by a grocer to allow oxygen to permeate non-barrier layer 16 and provide the product 12 with a bright red appearance or "bloom" which the consumer associates with freshness.

The present invention is directed to an improved package 10 wherein peeling of barrier layer 18 does not damage or otherwise adversely affect the integrity of the package, particularly the barrier film 20 of barrier tray 14, so that the grocer does not have to repackage product 12.

Vacuum skin packaging, as described previously, requires a substantially impermeable tray 14. The actual body 22 of tray 14 is typically a thermoformable foam material which is relatively permeable or pervious to gases. A barrier film 20 is typically applied to tray 14 to provide the required barrier to oxygen and other gases.

Figure 2:
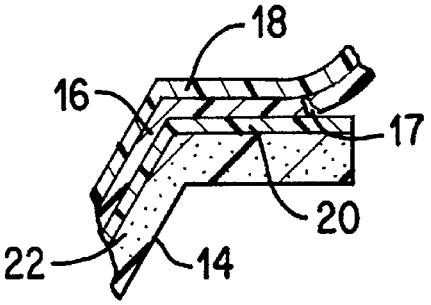
FIG. 2 PRIOR ART
FIGS. 2 and 3 illustrate prior art sealing of barrier and non-barrier layers to the barrier film of a barrier foam tray.
Figure 3:
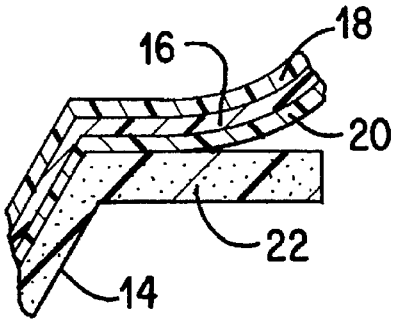
FIG. 3 PRIOR ART

FIG. 2 illustrates initiation of peeling of a barrier layer 18 of a conventional peelable package wherein non-barrier layer 16 and barrier layer 18 are sealed directly to tray 14 and, particularly, to barrier film 20 of tray 14. With this type of conventional package, initiation of peeling of barrier layer 18 is intended to cause a rupture 17 of non-barrier layer 16. Thus, barrier layer 18 is peeled while non-barrier layer 16 remains in place on tray 14. In this way, package 10 is intended to be ready for display after peeling of barrier layer 18 without the grocer having to repackage or otherwise treat the product. However, because of the materials used, the bond between film 20 and body 22 of tray 14 is a relatively weak bond. Thus, peeling of barrier layer 18 may in fact cause separation of film 20, as shown in FIG. 3, instead of the intended rupture of non-barrier layer 16, thereby marring the appearance of the package and potentially requiring the grocer to repackage the product.

The package according to the invention avoids this problem.

According to the invention, bottom web 24 (FIG. 1) covers the bottom portion of tray 14 and has extending edges 26 extending beyond the periphery of tray 14. A top web is provided which includes non-barrier layer 16 and peelable barrier layer 18. Non-barrier layer 16 of the top web is sealed to bottom web 24 in such a manner that peeling of barrier layer 18 from non-barrier layer 16 does not transmit potentially damaging force or stress to tray 14 and barrier film 20 thereof. Barrier layer 18 is therefore readily removable without risk of peeling or damaging barrier film 20. Package 10 according to the invention is therefore suitable for display by a grocer after peeling, without repackaging.

Figure 4:
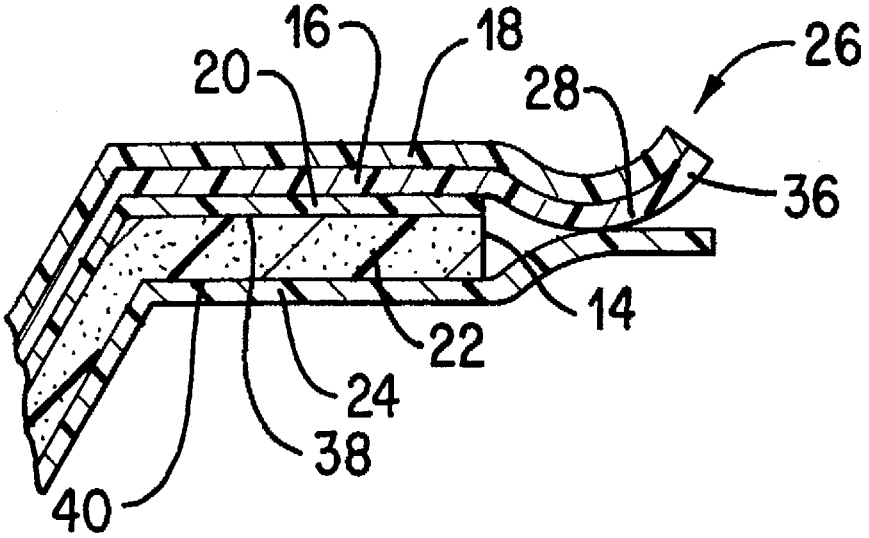
FIG. 4 is an enlarged section of a package according to the invention.

FIG. 4 shows an enlarged view of an edge of package 10, with barrier layer 18 partially peeled. Non-barrier layer 16 is sealed to bottom web 24 with a bond or seal having a strength greater than the internal strength of non-barrier layer 16 so that, when barrier layer 18 is peeled, non-barrier layer 16 will rupture at a point 28 of initiation of peeling, and non-barrier layer 16 remains sealed as desired to bottom web 24. As clearly illustrated in FIG. 4, such initiation of peeling does not result in damaging forces or stresses being applied to barrier film 20 of tray 14. Peeled package 10 is thereafter ready for display by the grocer.

Figure 5:
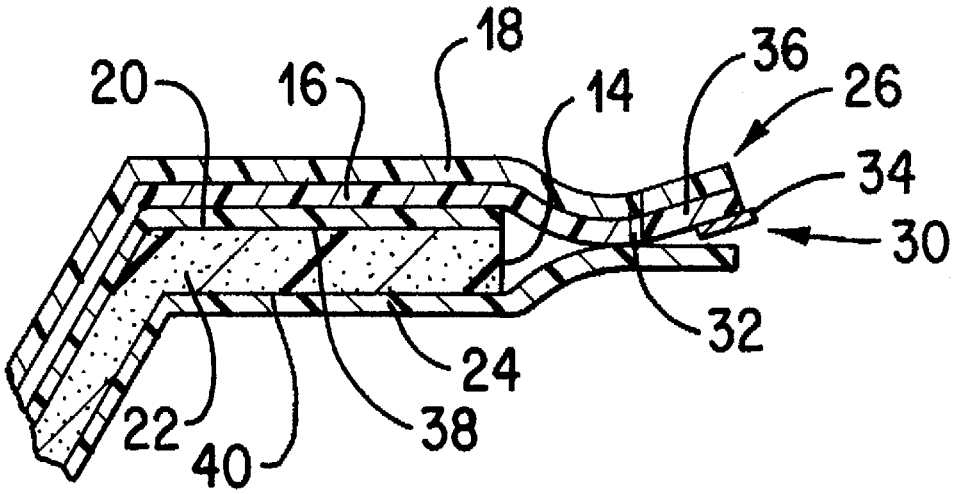
FIG. 5 is an enlarged section of an alternate embodiment of the invention.

FIG. 5 illustrates a preferred embodiment of the invention wherein a peel initiating tab structure 30 is provided to help initiate peeling in the proper location, and wherein perforations 32 are provided to help ensure proper initiation of peeling.

Tab structure 30 may preferably include a non-stick strip 34 of material positioned between non-barrier layer 16 and bottom web 24 so as to prevent adhesion of one of either non-barrier layer 16 or bottom web 24 to strip 34. This provides tab 30 which can be used to pull both non-barrier layer 16 and barrier layer 18 away from bottom web 24 up to rupture point 28. At this point 28, non-barrier layer 16 ruptures and remains in place sealed over product 12 and to barrier film 20 of tray 14 and bottom web 24. Further pulling the tab 30 results in continued separation and peeling of barrier layer 18 from non-barrier layer 16 as desired. Strip 34 may also be printed with various information or instructions, etc. for either the grocer or the consumer. In this regard, strip 34 containing information intended for the consumer would be adhered to bottom web 24 so as to remain in place on package 10 after peeling of barrier layer 18. A strip 34 containing instructions for the grocer would be adhered to non-barrier layer 16 (as shown in FIG. 5), on the portion 36 which separates upon peeling, so that such strip 34 is removed by peeling.

Perforations 32 are preferably provided at a point where initiation of peeling is desired. Such perforations 32 preferably penetrate at least non-barrier layer 16 so as to reduce the internal strength of non-barrier layer 16 so as to provide the desired rupture of non-barrier layer 16 at point 28 of initiation of peeling. Of course, numerous other means could be used for providing proper initiation of peel and rupture of non-barrier layer 16, such as score lines, folds and the like.

It should be noted that product 12 is preferably a fresh red meat product. However, package 10 according to the invention is also suitable for packaging any other product wherein it is desirable to provide a double layer, peelable outer layer package to a grocer.

Tray 14 may be any suitable support member for product 12 which is substantially gas impermeable. Tray 14 is preferably a conventional barrier foam tray which may preferably have an upper surface 38 and a lower surface 40, with film 20 disposed on upper surface 38. In accordance with the invention, a conventional and non-specialized barrier foam tray can be used which is desirable as a tray can be used which the consumer is familiar with. Further, there is no need to produce a film to foam bond in the tray having a particular minimum bond strength since the barrier film 20 is not subjected to peeling forces when peel of peelable barrier layer 18 is initiated.

Barrier layer 18 may be any suitable gas impervious film or layer or multitude of layers. Barrier layer 18 preferably has an oxygen permeation rate of less than or equal to about 50 cc per square meter of material per 24 hour period at 73° F. Layer 18 may typically include one or more layers of vinylidene chloride copolymers, PVDC, ethylene vinyl alcohol copolymers including hydrolyzed ethylene/vinyl-acetate copolymer (EVOH) or any other suitable material which provides the desired barrier characteristics.

Inner non-barrier layer 16 may comprise a single layer or several layers, and preferably allows at least about 2000 cc of oxygen to permeate per square meter per 24 hour period at 73° F. An example of suitable material for non-barrier layer 16 is polyethylene film, although numerous other suitable materials are available.

Bottom web 24 may be any suitable material and does not require any particular strength or gas barrier characteristics. Thus, the prime concern with bottom web 24 is to use material which is economically practical. Examples of suitable material include but are certainly not limited to monolayer polyolefin films, polyethylene/nylon laminates, and coextruded multilayer films.

Adhesive layers such as typical copolymer adhesive layers may be provided between the various above described layers to provide the desired relative strengths of bonds between the layers. For example, barrier layer 18 and non-barrier layer 16 are peelably bonded together while non-barrier layer 16 is more permanently bonded or sealed to bottom web 24 and also to barrier film 20 of tray 14.

Product 12 may suitably be packaged in accordance with the invention by providing tray 14 having barrier film 20 on an upper surface thereof, and supporting product 12 thereon. A bottom web 24 is positioned under tray 14 so as to cover bottom surface 40 of tray 14. Bottom web 24 has an extending portion which extends beyond the periphery or edges of tray 14.

Barrier and non-barrier layers 18, 16 are disposed, for example by vacuum skin packaging, so as to cover upper surface 38 of tray 14 and thereby to enclose product 12. Non-barrier layer 16 is sealed to the extending portions of bottom web 24. Of course, in a typical VSP process, non-barrier layer 16 will seal to barrier film 20 of tray 14 as well at points where it contacts upper surface 38 of tray 14. It should be noted that layers 16, 18 may be provided individually, or may be provided as a composite film which may be co-extruded, laminated or the like. The actual method used for providing the barrier and non-barrier layers forms no part of the present invention.

A peeling structure or manual pull tab 30 may be provided by arranging non-stick strip 34 along at least an edge of bottom web 24 prior to sealing of non-barrier layer 16 thereto. Pull tab 30 is provided between non-barrier layer 16 and bottom web 24 at one or more edges around the periphery of tray 14 so that initiation of peeling by pulling pull tab 30 away from bottom web 24 provides proper peeling without affecting tray 14. Package 10 is preferably perforated or scored along on edge of pull tab 30, as described above, to cause non-barrier layer 16 to rupture at rupture point 28 upon peeling so that the remaining non-barrier layer 16 stays in place on the package while peeling of barrier layer 18 continues. Such perforations may be formed through some or all layers and webs of package 10, at least including non-barrier layer 16, and may be formed at any point before or during the packaging of product 12, as desired. Non-stick strip 34 may comprise one or more layers of material selected and arranged so as to provide the desired adhesion to only one of bottom web 24 and non-barrier layer 16.

It is noted that barrier film 20 of tray 14 and barrier layer 18 define an inner space of package 10 for product 12. This inner space is preferably evacuated of oxygen, and may be flushed with a low oxygen content gas, so as to enhance the shelf life of the vacuum packed product 12.

Thus provided is a package and method for making same which provides package 10 with a peelable barrier layer 18 which can be peeled without adversely affecting the remainder of package 10, particularly without damaging barrier film 20 of barrier foam tray 14.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A package for a product, comprising:

a support member having a barrier film disposed thereon and supporting the product;

means for enclosing the product and the support member, the enclosing means comprising a first web means and a second web means sealed to the first web means for enclosing the product wherein the second web means comprises a non-barrier layer sealed to the first web means and a peelable barrier layer; and means for initiating peel of the peelable barrier layer from the non-barrier layer at a location where the non-barrier layer is sealed to the first web means whereby peeling of the peelable barrier layer does not cause peeling of the barrier film disposed on the support member.

2. A package according to claim 1, wherein the non-barrier layer encloses the product.

3. A package according to claim 1, wherein the barrier film is disposed on an upper surface of the support member, and the product is supported on the upper surface of the support member.

4. A package according to claim 1, wherein the first web means has a first portion which extends beyond a periphery of the support member and the second web means has a second portion extending beyond a periphery of the support member and sealed to the first portion, the peel initiating means being arranged so as to initiate peeling at the first and second portions.

5. A package according to claim 4, wherein the peel initiating means includes means arranged between the first portion and the second portion for preventing seal of the non-barrier layer to the first web means so as to provide a pull tab for initiating peeling of the peelable barrier layer.

6. A package according to claim 5, wherein the peel initiating means further includes a series of perforations arranged along an inner edge of the pull tab and penetrating at least the non-barrier layer.

7. A package according to claim 1, wherein the product is fresh red meat.

8. A package according to claim 1, wherein the barrier layer is substantially gas impervious.

9. A package according to claim 1, wherein the barrier layer has an oxygen permeability of less than or equal to about 50 cc per square meter per 24 hour period at 73° F.

10. A package according to claim 1, wherein the non-barrier layer has an oxygen permeability of at least about 2000 cc per square meter per 24 hour period at 73° F.

11. A package according to claim 1, wherein the peelable barrier layer and the barrier film define an interior space of the package for the product which is substantially free of oxygen.

12. A package according to claim 1, wherein the second web means comprises a co-extruded multi-layer film including the non-barrier layer and the peelable barrier layer.

13. A package according to claim 1, wherein the support member comprises foam sheet.

14. A package according to claim 13, wherein the barrier film is bonded directly to an upper surface of the foam sheet.

15. A method for packaging a product, comprising the steps of:

providing a support member having a barrier film disposed thereon and supporting the product;

providing a first and a second web means for enclosing the product and the support member wherein the second web means comprises a non-barrier layer and a peelable barrier layer;

sealing the non-barrier layer of the second web means to the first web means; and providing means for initiating peel of the peelable barrier layer from the non-barrier layer at a location where the non-barrier layer is sealed to the first web means whereby peeling of the barrier layer does not cause peeling of the barrier film disposed on the support member.

16. A method according to claim 15, further including enclosing the product with the non-barrier layer of the second web means.

17. A method according to claim 15, further including the steps of;

providing a first portion of the first web means which extends beyond a periphery of the support member;

providing a second portion of the second web means which extends beyond a periphery of the support member; and sealing the first portion to the second portion.

18. A method according to claim 17, further including providing the peel initiating means at the first and the second portions.

19. A method according to claim 18, further including providing means between a portion of the first and the second portions for preventing seal of the non-barrier layer to the first web means so as to provide a pull tab for initiating peel of the barrier layer from the non-barrier layer.

20. A method according to claim 19, further including perforating at least the non-barrier layer along an inner edge of the pull tab whereby, when the pull tab is pulled away from the first web means, the non-barrier layer ruptures along the perforations and remains sealed to the first web means and peeling of the barrier layer from the non-barrier layer is initiated.

21. A method according to claim 15, further including evacuating substantially all oxygen from an interior space of the package defined between the barrier layer and the barrier film whereby shelf life of the product is improved.

22. A method according to claim 15, further including flushing an interior space of the package defined between the barrier layer and the barrier film with a low oxygen gas before at least one of the sealing steps.

* * * * *